343-756
10/10/78 XR 4,119,932

United States Patent [19]
Bockrath

[11] 4,119,932
[45] Oct. 10, 1978

[54] LINEAR POLARIZATION SELECTIVE SCREEN

[75] Inventor: Thomas A. Bockrath, Hawthorne, Calif.

[73] Assignee: Hughes Aircraft Company, Culver City, Calif.

[21] Appl. No.: 702,787

[22] Filed: Jul. 6, 1976

[51] Int. Cl.² ..... H01P 1/165
[52] U.S. Cl. ..... 333/21 A; 343/756
[58] Field of Search ..... 333/21 A; 313/350; 350/318; 209/404; 55/147; 174/110 N; 343/756

[56] References Cited

U.S. PATENT DOCUMENTS 2,626,008 1/1953 Barr ..... 55/147 X
2,979,679 4/1961 Ellis ..... 333/21 A X
3,354,617 11/1967 Hoisington et al. ..... 55/147

*Primary Examiner*—Paul L. Gensler
*Attorney, Agent, or Firm*—John Holtrichter, Jr.; W. H. MacAllister

[57] ABSTRACT

A polarization selective screen allowing only electromagnetic waves having a desired linear polarization to pass therethrough, the screen includes an array of relatively thin, parallel and evenly spaced conductive flat ribbons supported between end portions of a frame structure, the broad surface of the ribbons being orthogonal to the plane of the screen and being supported and maintained in place under a predetermined tensional force by tension means such as spring-loaded ribbon hangers.

13 Claims, 7 Drawing Figures

Fig. 6.
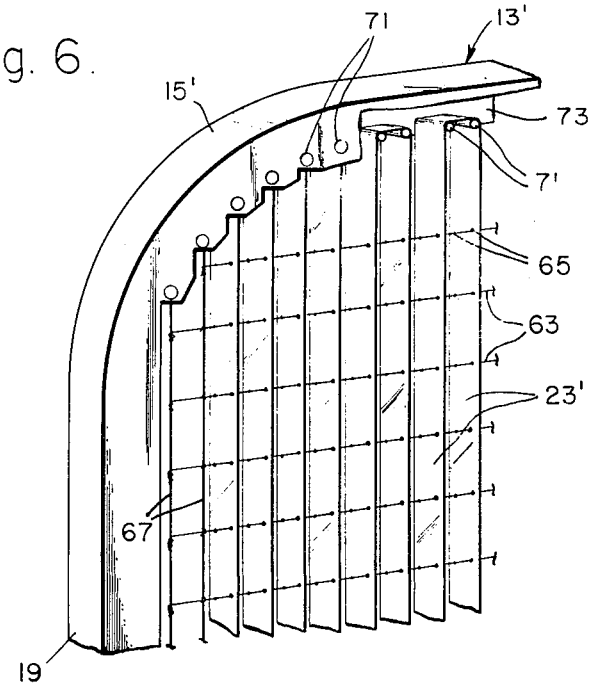
Fig. 7.
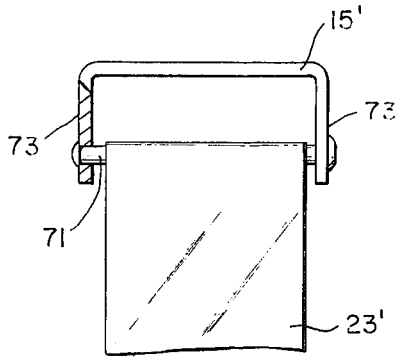
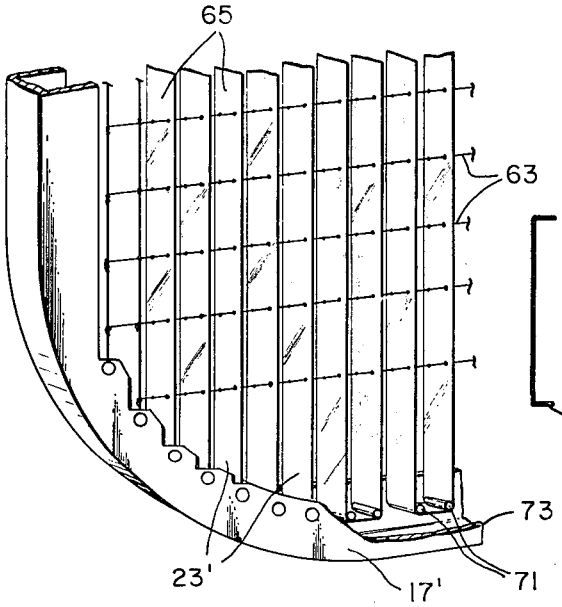
Fig. 5.
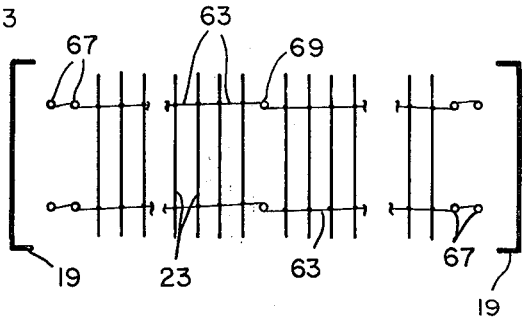
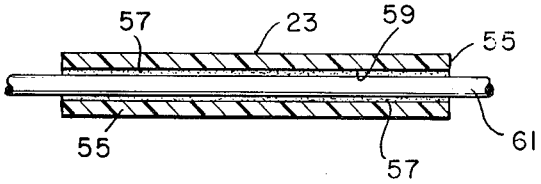
Fig. 4.

LINEAR POLARIZATION SELECTIVE SCREEN

BACKGROUND OF THE INVENTION

The background of the invention will be set forth in two parts.

1. Field of the Invention

This invention relates to electromagnetic wave devices and more particularly to polarization selective screens allowing the transmission of only such energy having a predetermined linear polarization.

2. Description of the Prior Art

Polarization selective screens (or grids) are well known in the art. The polarization of a propagating electromagnetic wave is generally considered less important for frequencies below about 50 MHz because at these relatively lower frequencies, the polarization of a wave is often unpredictably distorted by the effects of reflection, diffraction and refraction. On the other hand, at VHF, UHF and especially microwave frequencies, transmissions between two points is usually line-of-sight where less reflection, refraction or diffraction effects are generally experienced.

At UHF and microwave frequencies it has been found to be advantageous in some applications to differentiate between different polarizations. For example, where two incoming signals are to be separately received, but there is not a great separation in frequency between such signals, both signals would cause desensitization of the receiver front end adapted to receive the other signal. However, if these two signals are transmitted with orthogonal polarizations and a polarization selective screen is placed in front of the receiving antenna, a signal, even though relatively close in frequency but having a polarization orthogonal to that of the screen, will be rejected and will not cause the undesired desensitization. In other words, polarization selective screens can be used as highly advantageous filters for separating RF signals which are very closely spaced in frequency, whereas microwave filters capable of such a result are very costly and heavy and usually cannot provide good selectivity of each signal.

One such polarization selective screen, known in the art as a "Venetian blind" type, consists of aluminum sheets sandwiched between plastic foam and encapsulated by fiberglass facesheets. This design has the disadvantage of being heavy, has high insertion loss and is highly susceptible to solar torque in satellite applications.

SUMMARY OF THE INVENTION

In view of the foregoing factors and conditions characteristic of the prior art, it is a primary object of the present invention to provide a new and improved linear polarization selective screen.

Another object of the present invention is to provide an effective, lightweight linear polarization selective screen.

Still another object of the present invention is to provide a relatively simple-to-manufacture linear polarization selective screen that has relatively less insertion loss and is less susceptible to solar torque than prior art screens.

In accordance with one embodiment of the present invention, a linear polarization selective screen is provided for allowing electromagnetic waves having a desired polarization to pass therethrough. The screen includes a frame structure having first and second spaced end portions lying in a common plane with a plurality of relatively wide but thin conductive flat ribbons supported between the frame end portions. The broad surface of the ribbons are parallel to each other and are also orthogonal to the common plane of the frame structure. The invention also includes tension means associated with the frame structure and the ribbons for maintaining a predetermined tensional force on each of the ribbons in the polarizer array area.

The ribbons may be metal foil or metalized polyimide film, and preferably in the latter case, one or more inextensible threads running longitudinally along the ribbons are bonded thereto in order to significantly reduce stretching.

In addition, at least one end of each of the ribbons may be held in tension by a spring-loaded hanger attached to the frame structure, and the ribbons may be constrained to act uniformly by stabilizing structures such as pairs of nonconductive strings threaded through the ribbons at right angles to the length of the ribbons, each of the pairs of stabilizing strings defining a plane perpendicular to that of the ribbons and the frame structure.

The features of the present invention which are believed to be novel are set forth with particularity in the appended claims. The present invention, both as to its organization and manner of operation, together with further objects and advantages thereof, may best be understood by making reference to the following description taken in conjunction with the accompanying drawings, in which like reference characters refer to like elements in the several views.

BRIEF DESCRIPTION OF THE DRAWINGS

FIG. 4 is an enlarged sectional view of one of the reinforced ribbons seen in FIGS. 1–3;

FIG. 5 is a schematic illustration of the ribbon stabilizing structure employed in the embodiment of FIG. 1;

FIG. 6 is a partial perspective view of an electromagnetic wave polarizer constructed in accordance with another embodiment of the present invention; and FIG. 7 is an enlarged view of a ribbon hanger shown in the embodiment of FIG. 6.

DESCRIPTION OF THE PREFERRED EMBODIMENTS

Figure 1:
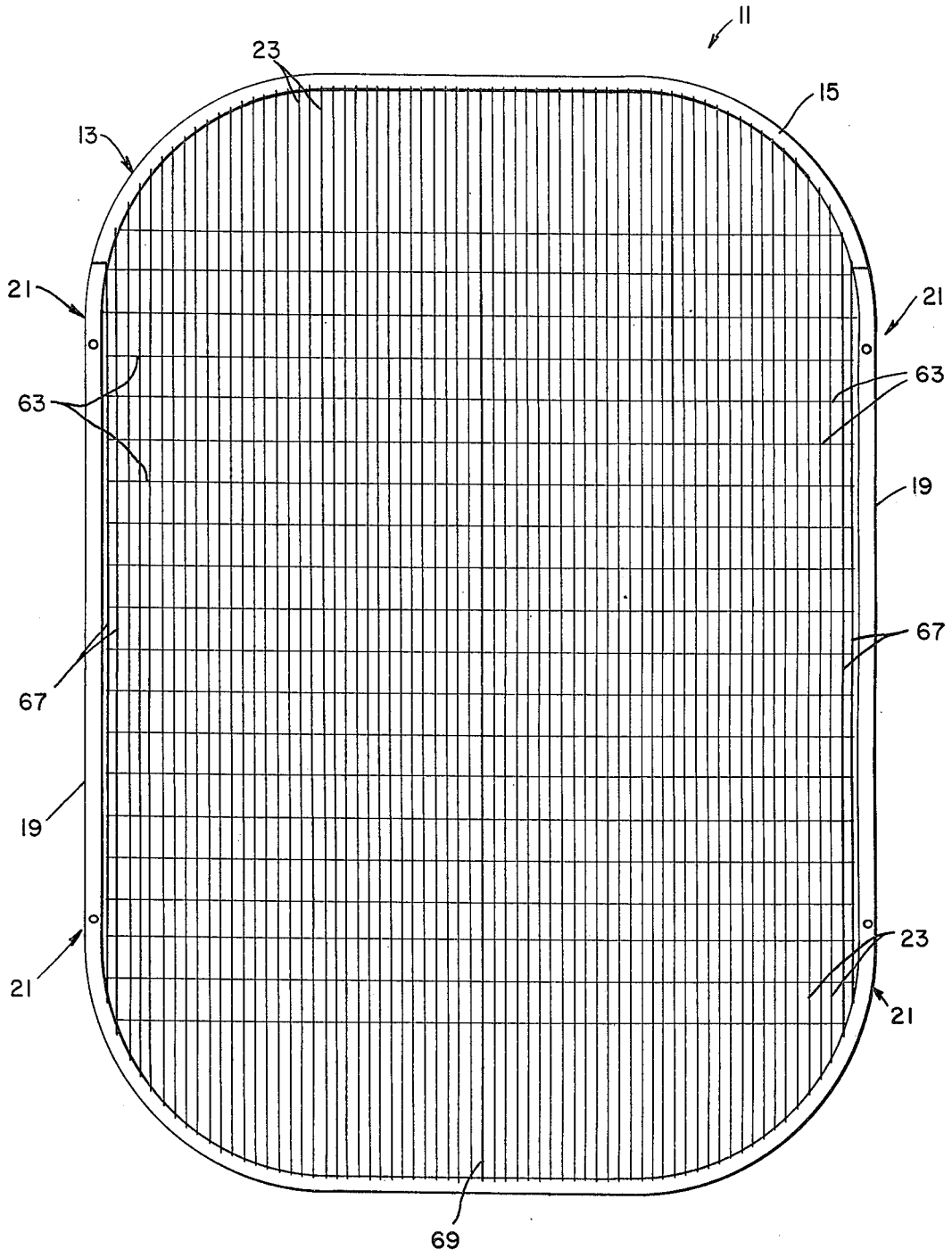
FIG. 1 is a front elevational view of a horizontal polarization selective screen constructed in accordance with one embodiment of the present invention.
Figure 3:
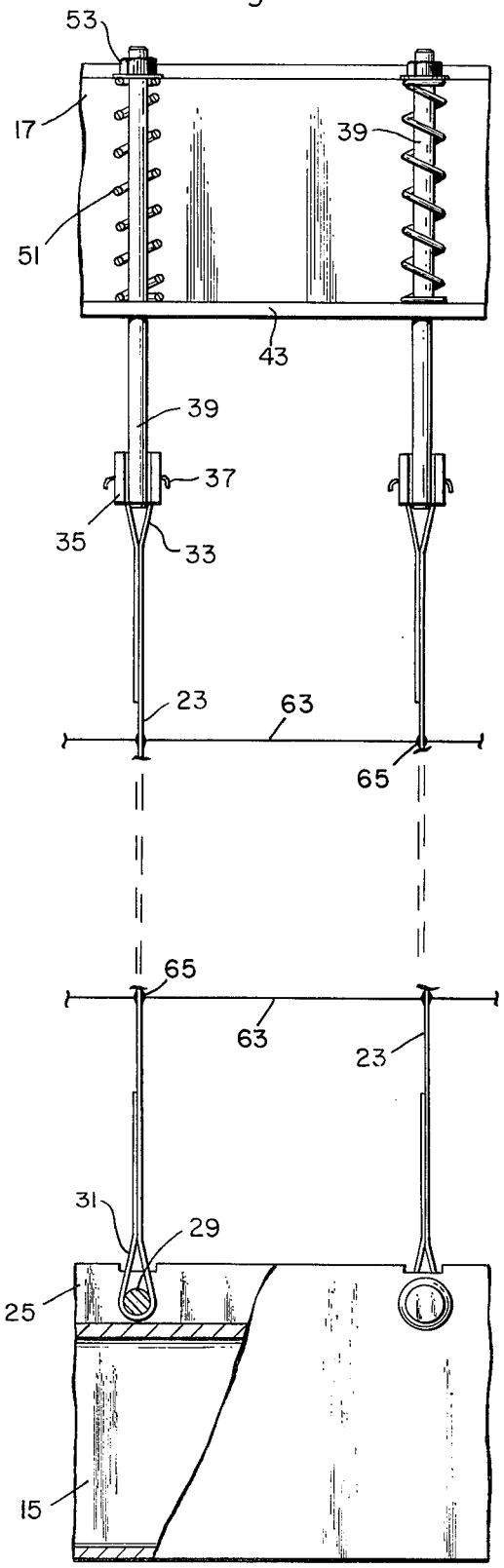
FIGS. 2 and 3, respectively, are orthogonal enlarged views of portions of the ribbon and ribbon support structure shown in FIG. 1.
Figure 2:
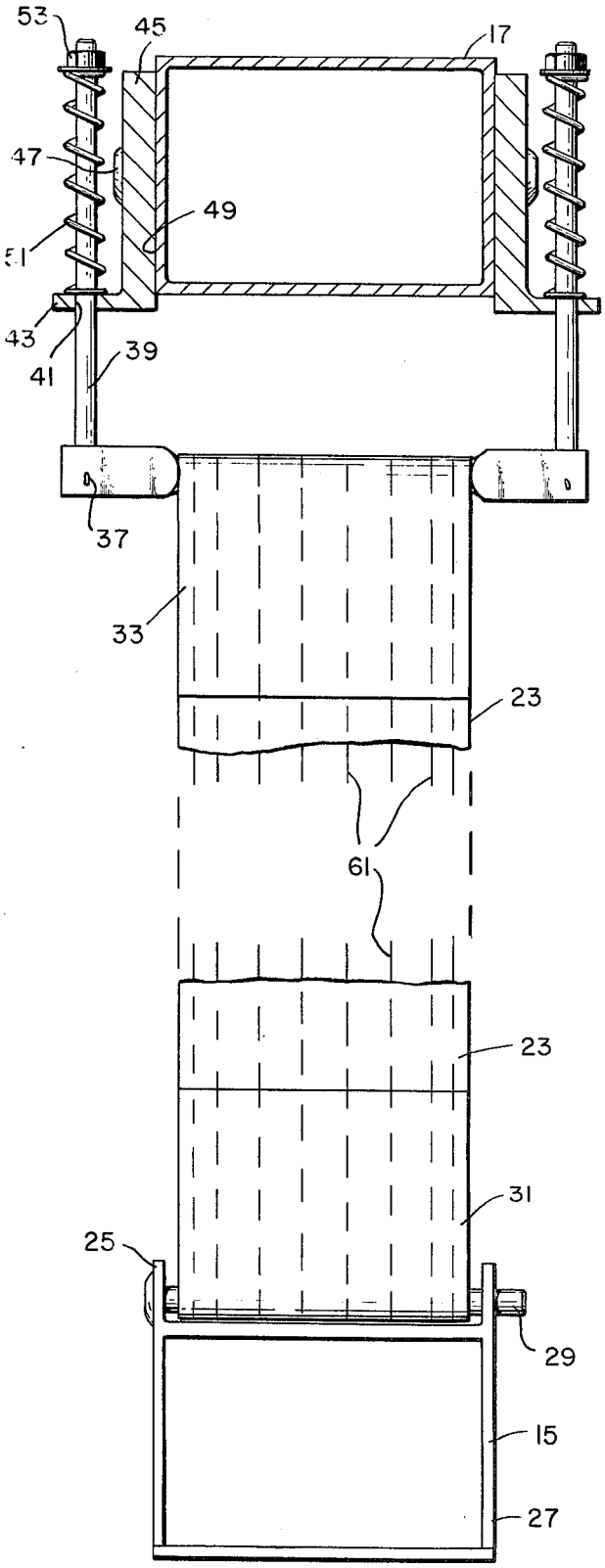

Referring now to the drawings and more specifically to FIGS. 1–3, there is shown a linear polarization selective screen 11 with a frame structure 13 having an upper end portion 15, a lower end portion 17 and side portions 19. The portions of the frame structure 13 may be extruded hollow rectangular aluminum tubing appropriately curved to form its desired shape. The upper and lower portions 15 and 17 are preferably fabricated separately from the side portions 19 and bolted, welded or otherwise connected together at mating corners 21 to form an integral frame unit defining a common plane.

Disposed within the ribbon array area defined by the inner peripheral sides of the frame structure 13 are a plurality of parallel, thin conductive ribbons 23. The actual dimensions of the ribbons depend upon frequency of operation, bandwidth, and desired polarization or filter effectiveness. In this example for operation in the 4 to 6 GHz region, the ribbons are approximately 1.00 inch wide, have a thickness of 0.004 inch, and are spaced 0.005 inch apart over a frame having an approximate inside dimension of 70 inches by 50 inches. Where it is desired to provide linear polarization selective screen of the type herein described but for operation at another frequency and/or with other filter characteristics, reference may be made to numerous publications on the subject of "Venetian blind" type polarizers. One article on this subject is by C. C. Chen and K. C. Lang in M74 International IEEE/AP-S Symposium Program and Digests, June 10–12, 1974, entitled "A General Numerical Solution for the Analysis of a Class of Infinite Parallel Plate Gratings."

In all embodiments of the invention, the ribbons are placed under approximately uniform tensional forces in order to provide the desired ribbon shape and uniformity of ribbon shapes under all operating conditions such as environmental changes and inherent stretching of the ribbon material. FIGS. 2 and 3 illustrate a spring-loaded tensional loading system including a fixed ribbon support with apertured flanges 25 extending inwardly from the front and rear faces 27 of the upper frame portion 15 and through which flanges 25 are mounted bars 29 passing through loops 31 at the upper ends of each of the ribbons 23.

At the opposite end of each ribbon is a loop 33 through which extends a bar 35. The ends of the bar 35 are attached by pins 37 to arms 39 that slidably extend through appropriately dimensioned slide bearing apertures 41 in outwardly extending flange portion 43 of brackets 45 fixedly attached by any conventional means such as rivets 47 to the front and rear faces 49 of the lower frame structure portion 17. In order to provide the desired tensional force on the ribbons 23, the arms 39 are each urged outwardly by the action of coil spring 51 mounted around the arms 39 and captured between the flange portions 43 and a spring retaining washer/nut assembly 53 at the outwardly extending threaded ends of the arms 39. The amount of tension applied to each ribbon depends upon the characteristic of the ribbons and obvious environmental factors. In one constructed device, a tensional load of 0.6 pound was utilized successfully.

The ribbons 23 are required to be conductive at microwave frequencies, but may be constructed in various forms. For example, the ribbons 23 may be metal foil such as aluminum foil of membrane thickness. Another form, which is presently preferred, is to bond together two very thin plastic strips or films 55 having metal depositions 57 on their respective inner surfaces 59. In order to provide resistance to possible creeping or stretching which causes sagging of the ribbons, this embodiment includes a plurality of string threads 61 bonded within the plastic film sandwich running parallel to the longitudinal axes of the ribbons, as illustrated in FIG. 4.

In both the first described embodiment of the invention and in the one shown in FIGS. 6 and 7, ribbon stabilizing structure may be utilized in order to assure that all the ribbons react to external influences together and uniformly. This may be accomplished by utilizing pairs of transversely disposed threads or strings 63 extending through and fixedly bonded to appropriate holes 65 in the ribbons. The ends of the transverse threads 63 are attached to anchor wires 67 running parallel to the ribbons 23 at opposite sides of the ribbon array and adjacent the side portions 19 of the frame structure 13. The threads 63 may also be further supported providing another set of anchor wires 69 at the center of the array (see FIG. 1), for example. The stabilizing structure is best illustrated in FIGS. 5 and 6. The wires 67 and 69 thus provide anchoring points for the strings 63 and tend to cause the strings to act in unison. Since the strings act in unison, they, in turn, cause the ribbons to act uniformly.

The ribbons 23' shown in FIGS. 6 and 7 could be made of the aforementioned solid metal films and, as in this embodiment, they could be formed by a single continuous ribbon run back and forth in a serpentine fashion between fixed pins 71 anchored in inwardly extending flanges 73 making up the front and rear faces of the upper and lower frame portions 15' and 17'. Here, the frame 13' is temporarily deformed inwardly before installing the ribbon 23' so that when the temporary external deformation-causing force is removed, a potential energy level is maintained in the frame itself to cause a uniform tensional load on each length of ribbon in the array area. Also, the ribbon or ribbons may be fabricated from a material which exhibits at least a limited elastic characteristic so that the desired tension may be provided by initially stretching the ribbon or ribbons, or this feature can be used in conjunction with the other described means for maintaining the ribbon array under a uniform tensional load.

It should be noted that the flanges 25, 43 and 73 may be individual elements or they may be formed as an integral part of the frame assembly. As shown in FIG. 1, the inner surface of the lower frame portion is shaped in such a way to provide sufficient clearance for the spring-loaded hanger assemblies. Thus, it is evident that the materials, structures and processes illustrated and described herein are not critical, and any other materials, structures and processes exhibiting similar desirable characteristics may be utilized.

From the foregoing it is clear that there has been described a new and advantageous lightweight and reliable linear polarization selective screen which truly constitutes a significant advancement of the art.

Although specific embodiments of the invention have been described in detail, it should be understood that changes, modifications and other embodiments of the invention which are obvious to persons skilled in the art to which the invention pertains are deemed to lie within the spirit, scope and contemplation of the present invention. For example, instead of the longitudinal axes of the ribbons being vertical, the ribbons may be horizontally orientated.

What is claimed is:

1. A linear polarization selective screen for interaction with electromagnetic wave energy associated with an antenna and allowing only electromagnetic waves having a desired linear polarization to pass therethrough, said screen comprising:

frame structure including first and second spaced end portions lying in a common plane;

a plurality of relatively thin conductive flat ribbons supported between said end portions of said frame structure, said ribbons being at substantially the same potential, and the broad surfaces of said ribbons being parallel and orthogonal to said common plane of said frame structure; and tension means associated with said frame structure and said ribbons for maintaining a predetermined tensional force on each of said ribbons.

2. The screen according to claim 1, wherein said ribbons are metal strips.

3. The screen according to claim 1, wherein said ribbons are made of metallized polyimide film.

4. The screen according to claim 1, wherein said ribbons are a pair of polyimide films each having a metal coating on one side thereof, said films being bonded together with said metal coatings therebetween.

5. The screen according to claim 4, wherein said ribbons also include at least one longitudinal thread extending colinearly with said ribbons.

6. The screen according to claim 1, wherein said ribbons are independently supported between said end portions of said frame structure.

7. The screen according to claim 1, wherein said ribbons are defined by a unitary serpentine configuration.

8. The screen according to claim 1, wherein said plurality of ribbons supported between said end portions of said frame define a ribbon array, and said screen also comprising pairs of anchor elements mounted on said frame structure disposed on each side of said ribbon array and parallel to said ribbons, each of said pairs of elements defining a plane parallel to the planes of the broad surfaces of said ribbons, and further comprising a plurality of spaced pairs of ribbon stabilizing strings extending through and fixedly attached to each of said ribbons in said array, each of said pairs of strings defining a plane orthogonal to said common plane and to the planes of the broad surfaces of said ribbons and being attached at each of their respective ends to an associate one of said anchor elements.

9. The screen according to claim 8, further comprising an additional pair of anchor elements centrally disposed in said ribbon array and defining therebetween a plane parallel to the planes defined by said pairs of said anchor elements, each of said ribbon stabilizing strings being fixedly attached to an associated one of the anchor elements of said additional pair of anchor elements.

10. The screen according to claim 1, wherein said frame structure is pre-deformed, and wherein said tension means includes the outwardly directed potential energy present in said pre-deformed frame structure.

11. The screen according to claim 1, wherein said tension means includes spring-loaded ribbon hangers disposed at least at one end of each of said ribbons.

12. The screen according to claim 11, wherein each of said ribbon hangers includes a pair of brackets attached to opposite sides of said end portions of said frame structure, a transverse bar attached to one end of one of said ribbons, and also includes a pair of spaced arms each attached to an opposite end of said transverse bar and extending perpendicular thereto and through associated slidable bearing openings in associated ones of said brackets, each of said ribbon hangers further including a coil spring disposed about that portion of each of said arms extending beyond said bracket on the opposite side of said transverse bar, said spring being captured between a spring anchor on said arm and said bracket to exert a balanced force along the length of said transverse bar in a direction perpendicular to said bar and toward said frame structure.

13. The screen according to claim 1, wherein said tension means includes the inherent elasticity of the material of each of said ribbons.

* * * * *